US008472819B2

(12) United States Patent
Chaplin et al.

(10) Patent No.: US 8,472,819 B2
(45) Date of Patent: Jun. 25, 2013

(54) TONER BOTTLE PRESENCE AND LEVEL SENSING USING WEIGHT

(75) Inventors: Ben Chaplin, London (GB); Michael J. Wilsher, Letchworth (GB); Christopher Watts, St. Albans (GB); James Wood, London (GB)

(73) Assignee: Xerox Corporation, Norwalk, CT (US)

( * ) Notice: Subject to any disclaimer, the term of this patent is extended or adjusted under 35 U.S.C. 154(b) by 274 days.

(21) Appl. No.: 12/917,679

(22) Filed: Nov. 2, 2010

(65) Prior Publication Data

US 2012/0106989 A1 May 3, 2012

(51) Int. Cl.
*G03G 15/08* (2006.01)

(52) U.S. Cl.
USPC ..... 399/27

(58) Field of Classification Search
USPC ..... 399/13, 27
See application file for complete search history.

(56) References Cited

U.S. PATENT DOCUMENTS 5,731,824 A 3/1998 Kneezel et al.
6,097,903 A * 8/2000 Yahata et al. ..... 399/27
6,154,619 A 11/2000 Boockholdt et al.
6,246,841 B1 6/2001 Merrifield et al.
2007/0013727 A1 1/2007 Jung
2009/0090878 A1 4/2009 Toh et al.

FOREIGN PATENT DOCUMENTS

JP 6348133 A 12/1994
JP 2005316034 A * 11/2005

OTHER PUBLICATIONS

Machine Translation of JP 2005-316034 A, obtained on Sep. 27, 2012.*
GB Search Report, British Application No. GB1118730.9, Mailed Feb. 20, 2012, Dated Feb. 17, 2012, Intellectual Property Office of Great Britain.

* cited by examiner

*Primary Examiner* — David Gray
*Assistant Examiner* — Gregory H Curran
(74) *Attorney, Agent, or Firm* — Fay Sharpe LLP

(57) ABSTRACT

An image forming apparatus is adapted to distinguish a presence between a full and a partially-full toner cassette. The image forming apparatus includes a load cell positioned in a developer station. The load cell is adapted to sense a mass of a toner cassette at least during an insertion of the toner cassette into the apparatus. A processor is adapted to determine a toner volume contained in the toner cassette based on a mass differential. A controller is adapted to drive or suspend a motor in the developer station to control an operation of the image forming apparatus. The controller controls the operation based on the toner volume.

19 Claims, 5 Drawing Sheets

TONER BOTTLE PRESENCE AND LEVEL SENSING USING WEIGHT

BACKGROUND

The present application is directed toward a system for detecting toner level in a cassette inserted into an image forming apparatus and, more specifically, to a system utilizing a sensed mass.

In known methods of print processing, toner particles mix with carrier beads included in a developer station. The mixture is then transferred to a surface portion of a photoreceptor drum. The toner particles are transferred from the drum surface to an image bearing substrate moving on a transfer belt. The toner particles are then fused onto the image bearing substrate.

It is desirable that the mixture includes predetermined, equal rations of carrier beads to toner particles. A disproportionate ration is indicative of a low level of toner in a cartridge contained in the cassette. If an image forming apparatus continues to operate on the low-level of toner, there increases a risk of damaging stations of the apparatus. For example, carrier beads may damage a surface of the sensitive photoreceptor drum. This damage may lead in a long term to image quality defects and more permanent mechanical problems.

A current technique practiced by many operators is a shake-up approach. In an attempt to reinsert the low-level toner cassette for continued operation, operators remove the cassette from a main body of the image forming apparatus, shake the cassette to distribute the remainder of toner volume, and reinsert the cassette for utilization in additional printing cycles. This technique may lead to a risk of damaging the stations as the machine stresses to operate on pulling a volume of air instead of a steady volume of toner. One method used to estimate a volume of toner in a cassette includes automatically tracking a number of media sheets output from the image bearing apparatus. One disadvantage associated with this technique is that the estimate is based off of average toner consumption for sheets. If the output requires additional toner to render images, the deviation is not considered. Accordingly, the indicated toner level may not match the actual volume.

There is no current system for distinguishing between full level and low level toner cassettes inserted in an image forming apparatus. It is desirable for a system to distinguish between new and used cassettes for extending a life of the apparatus.

BRIEF DESCRIPTION

A first exemplary embodiment of the disclosure is directed toward an image forming apparatus adapted to distinguish a presence between a full and a partially-full toner cassette. The image forming apparatus includes a load cell positioned in a developer station. The load cell is adapted to sense a mass of a toner cassette at least during an insertion of the toner cassette into the apparatus. A processor is adapted to determine a toner volume contained in the toner cassette based on a mass differential. A controller is adapted to drive or suspend a motor in the developer station to control an operation of the image forming apparatus. The controller controls the operation based on the toner volume.

A second embodiment of the disclosure is directed toward an image forming apparatus adapted to control a print operation based on a detected toner cassette. The image forming apparatus includes a developer station. An auger mechanism includes an auger screw in rotatable position within a stationary spigot. The auger screw is adapted to pull toner from a toner cassette. A motor is adapted to rotate the auger screw. A dock station supports the toner cassette. The apparatus further includes a load cell positioned in a front region of the dock station. The load cell is more specifically positioned at a distance from an interface between the auger screw and the toner cassette. The load cell is adapted to detect a deflection made by the toner cassette. The load cell is further adapted to detect a mass of the toner cassette. The mass is representative of a volume of toner contained in the toner cassette.

A third embodiment of the disclosure is directed toward a method for detecting a fullness level of toner in a cassette inserted into an image forming apparatus. The method includes at least partially inserting a toner cassette into a developer station of the image forming apparatus. A load cell is determined as being deflected by the toner cassette. A processor searches for a full mass representative of a full toner cassette when the load cell is deflected. A signal representative of the mass is sent to the processor. A controller controls an operation of a print cycle based on the signal.

DETAILED DESCRIPTION

The present application is directed toward a load cell that senses a mass of a toner cassette inserted into an image forming apparatus. The load cell is incorporated into a system that uses the mass to determine a toner fullness level of the cassette. An operation of the image forming apparatus is based on the fullness level.

As used herein, an image forming device can include any device for rendering an image on print media, such as a copier, laser printer, bookmaking machine, facsimile machine, or a multifunction machine (which includes one or more functions such as scanning, printing, archiving, emailing, and faxing). "Print media" can be a usually flimsy physical sheet of paper, plastic, or other suitable print media substrate for carrying images.

The term "software" as used herein is intended to encompass any collection or set of instructions executable by a computer or other digital system so as to configure the computer or other digital system to perform the task that is the intent of the software. The term "software" as used herein is intended to encompass such instructions stored in storage medium such as RAM, a hard disk, optical disk, or so forth, and is also intended to encompass so-called "firmware" that is software stored on a ROM or so forth. Such software may be organized in various ways, and may include software components organized as libraries, Internet-based programs stored on a remote server or so forth, source code, interpretive code, object code, directly executable code, and so forth. It is contemplated that the software may invoke system-level code or calls to other software residing on the server or other location to perform certain functions.

Figure 1:
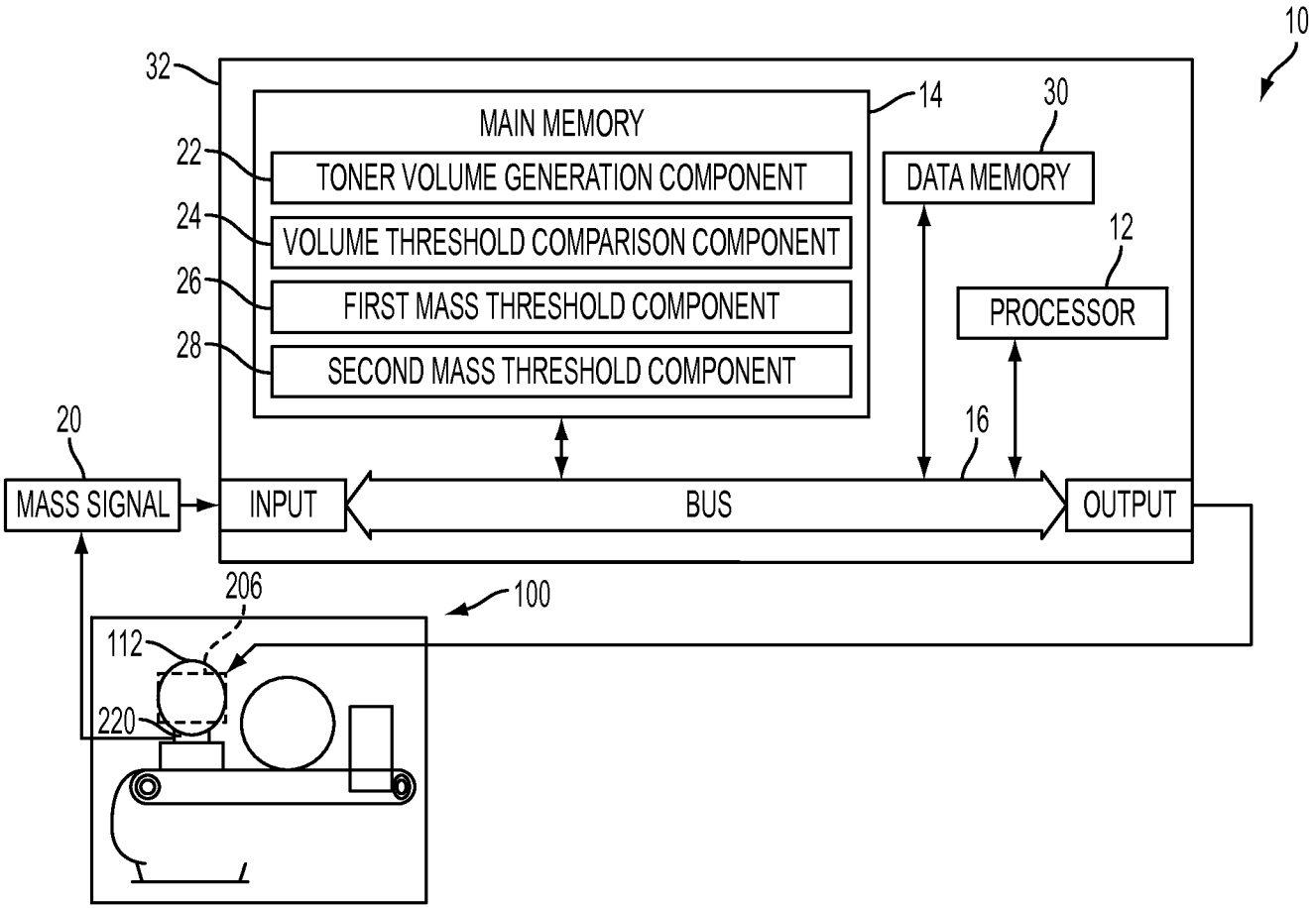
FIG. 1 is a functional block diagram of a computer system using a load cell for controlling a print operation according to an embodiment of the disclosure.

The method illustrated in FIG. 1 may be implemented in a computer program product that may be executed on a computer. The computer program product may comprise a non-transitory computer-readable recording medium on which a control program is recorded, such as a disk, hard drive, or the like. Common forms of non-transitory computer-readable media include, for example, floppy disks, flexible disks, hard disks, magnetic tape, or any other magnetic storage medium, CD-ROM, DVD, or any other optical medium, a RAM, a PROM, an EPROM, a FLASH-EPROM, or other memory chip or cartridge, or any other tangible medium from which a computer can read and use.

Alternatively, the method may be implemented in transitory media, such as a transmittable carrier wave in which the control program is embodied as a data signal using transmission media, such as acoustic or light waves, such as those generated during radio wave and infrared data communications, and the like.

With reference to FIG. 1, a functional block diagram of a computer system 10 is shown. The illustrated computer system 10 includes a processor 12, which controls the overall operation of the computer system 10. The processor 12 executes processing instructions, which are stored in memory 14 connected to the processor 12. Computer system 10 also includes a network interface and a user input/output (I/O) interface. The I/O interface may communicate with one or more of a display, for displaying information to users, and a user input device, such as a keyboard or touch or writable screen, for inputting instructions, and/or a cursor control device, such as a mouse, trackball, or the like, for communicating user input information and command selections to the processor. The various components of the computer 10 may be all connected by a bus 16. The processor 12 executes instructions for performing the method outlined in FIG. 5. The computer system 10 may be a PC, such as a desktop, a laptop, palmtop computer, portable digital assistant (PDA), server computer, cellular telephone, pager, or other computing device (e.g., the multifunction printer/copier device) capable of executing instructions for performing the exemplary method.

As previously stated, the memory 14 may represent any type of tangible computer readable medium such as random access memory (RAM), read only memory (ROM), magnetic disk or tape, optical disk, flash memory, or holographic memory. In one embodiment, the memory 14 comprises a combination of random access memory and read only memory. In some embodiments, the processor 12 and memory 14 may be combined in a single chip. The network interface allows the computer to communicate with other devices via a computer network, such as a local area network (LAN), a wide area network (WAN), or the internet, and may comprise a modulator/demodulator (MODEM). The memory 14 stores instructions for performing the exemplary method as well as the processed data.

FIG. 1 further illustrates the computer system 10 connected to a load cell 220 for inputting a sensed or measured mass value into the computer system 10. The mass data 20 is processed by the processor 12 according to the instructions contained in the memory 14. The memory 14 stores at least one of a percentage toner volume generation (i.e., calculation/conversion component) 22, a volume threshold comparison component 24, a first mass threshold comparison component 26, and a second mass threshold comparison component 28. These components 22-28 will be later discussed with reference to the method. The sensed mass data undergoes processing according to the various components for generating a print instruction, which is stored in the data memory 30.

The sensed mass data is in communication with a controller 32 containing the processor 12 and memories 14, 30. The controller 32 may be formed as part of at least one image forming apparatus 100 for controlling an operation of at least one marking (or print) engine for rendering images on print media. Alternatively, the controller 32 may be contained in a separate, remote device that is connected with the image forming apparatus 100. Instruction data is output from the controller 32 for further processing at the print engine. For example, this instruction data may control a motor 206 operation for completing a print cycle.

Figure 2:
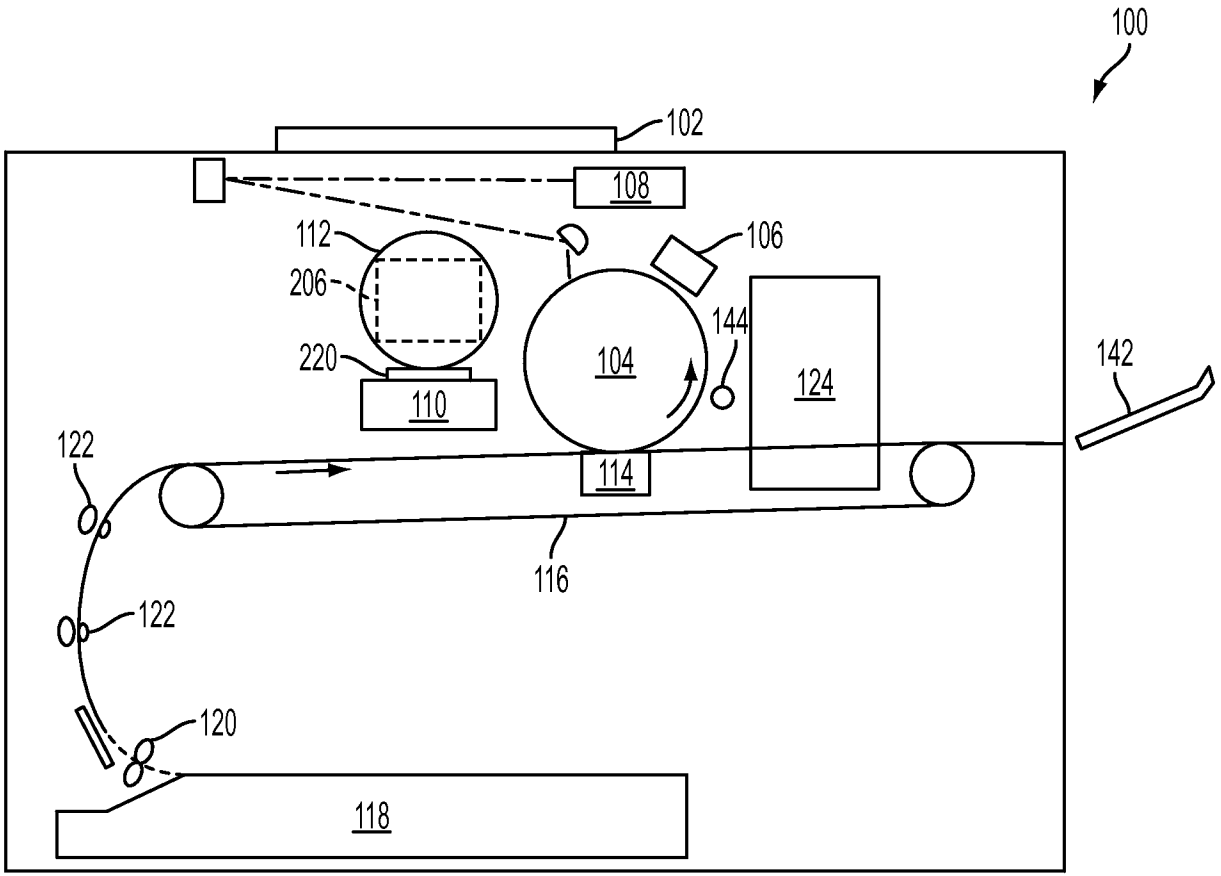
FIG. 2 is a schematic illustration of the load cell incorporated in an image forming apparatus.

FIG. 2 more specifically illustrates a schematic representation of processing stations used in stages of a print cycle. The processing stations are incorporated in an image forming apparatus 100. The stages are sequentially accomplished corresponding to the following description. An original image bearing element (not shown) is placed on a platen 102. A motor drives rotation of a photoreceptor 104 (synonymously referred to as "drum"). A charging station 106 electrically charges a surface of the drum 104. An exposure station 108 scans the original image bearing element. The exposure station 108 forms an electrostatic latent image on the charged surface of the drum 104. This electrostatic latent image is an optical image in an image configuration. More specifically, a light source, mirrors, and at least one focusing lens expose the image to the photoreceptor drum 104. A developer station 110 (hereinafter synonymously referred to as "developer mechanism") develops the electrostatic latent image into visible form (i.e., a toner image). A toner containing component 112, such as a cartridge or cassette, dispenses toner particles into a developer housing where they mix with carrier beads. A developer roll deposits the toner onto the charged photoreceptor drum 104 surface. A transfer station containing component 4 transfers the developed image to a media sheet. More specifically, the media sheet moves on a transfer belt 116 in synchronous relation to the toner image. A tray 118 supplies the media sheet from a stack. A substrate feed mechanism 120 feeds a top sheet of media stacked in the tray 120 toward the photoreceptor drum 104 using roller pairs 122 situated along a feed path. An electric field at the transfer station containing component 114 includes a corotron for transferring the toner particles onto the media sheet. A fusing station 124 fixes the image to the media by an application of heat and pressure. The media bearing the copied image is lastly delivered to an output tray 142. A brush included in a cleaning station 144 scrapes residual toner particles from the surface of the drum 104. The process is repeated for forming a next image.

The toner containing component 112 is a consumable and/or replaceable housing installed in the image forming apparatus 100 for printing pigmented and/or clear toners onto various media types. The toner containing component 112 generally includes an elongate body with an aperture (not shown) at a first end. The aperture receives an auger 204 of the developer mechanism 110. The toner containing component 112 includes the aperture situated in a sidewall for egress of powdered toner toward the photoreceptor drum 104. The aperture (hereinafter synonymously referred to as an "opening") is more specifically situated through a front end of the toner containing component 112. The aperture is situated closer to the dispenser and transfer systems when the toner containing component 112 is rotatably mounted in the image forming apparatus 100.

Figure 3:
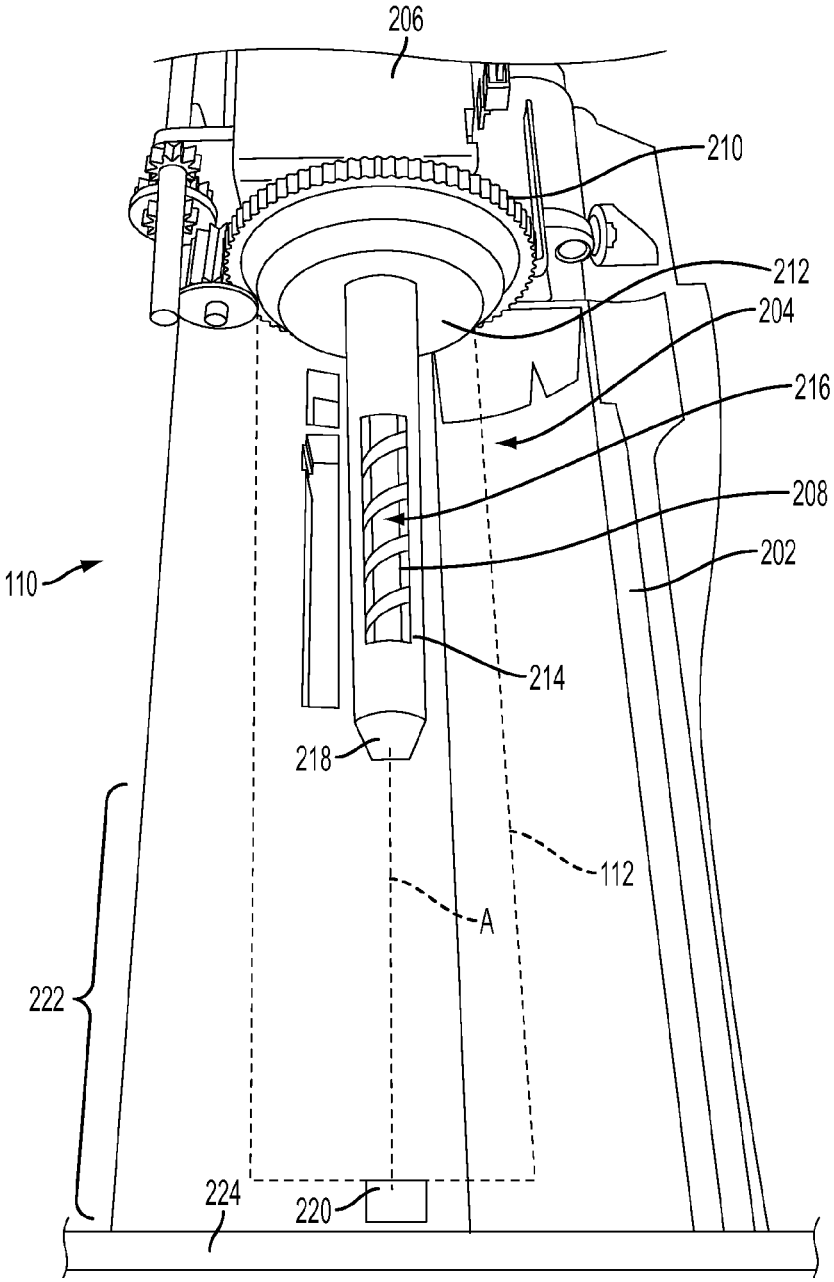
FIG. 3 is a top elevational view of a developer mechanism including the load cell in accordance with an embodiment of the disclosure.

The toner containing component 112 mounts about a dock station 202 of the developer mechanism 110 in the image forming apparatus 100. The dock station (synonymously referred to as a "platform") 202 is contained inside the image forming apparatus 100 and is accessible by means of a front door panel 224. The dock station 202 may be part of the developer mechanism 110. The general developer mechanism 110 is illustrated in FIG. 3 to include an auger 204 extending outwardly from a motor 206. Both the auger 204 and the motor 206 form part of the main body of the image forming apparatus 100. The auger 204 includes a rotating auger screw 208 (synonymously referred to as an auger "bit"), which is rotatably driven by the motor 206. Also attached to the motor 206 is a gear 210 for rotating the toner containing component 112 once it is solidly mounted onto a support plate 212. The support plate 212 is illustrated as being fixedly connected to an outer oriented face of the gear 210. A stationary spigot 214 (synonymously referred to as a "shroud") similarly extends outwardly from the motor. The stationary spigot 214 extends beyond a terminal end of the auger bit 208. The stationary spigot 214 extends along a longitudinal length of the auger screw 208 and, additionally, surrounds a circumferential surface of the auger screw 208. At least one longitudinally extending aperture 216 is formed through a circumferential length portion of the stationary spigot 214. The longitudinally extending aperture 216 functions to provide contact between the powdered toner and the rotating auger screw 208.

The present disclosure is directed toward a load cell 220 incorporated in the image forming apparatus 100. The load cell 220 is illustrated in FIG. 3 and includes a sensor and/or detector mechanism situated in the developer region of the image forming apparatus 100. The load cell 220 functions to detect a presence of the toner containing component 112 being inserted into the image forming apparatus 100. The load cell 220 is further adapted to take a characteristic measurement of the toner containing component 112. The characteristic measurement is indicative of a toner fullness level contained in the toner containing component (i.e. cartridge), which may be housed in a cassette. The characteristic measurement is a cassette mass.

In more specific detail, the load cell 220 is a stationary sensor positioned relative to the auger mechanism 204 in the developer station 110. The load cell 220 may be removed a distance from a direct contact with any moving component in the developer station 110, such as, for example, the gear 210 and the auger screw 208. It is important that the load cell 220 be positioned out of contact with an interface between the toner cassette 112 and the rotating auger screw 208 because toner is picked up at the interface for loading into the developer. Accordingly, the load cell 220 may be situated at a position that would not obstruct a toner pick-up operation.

In one embodiment, the load cell 220 may be fixedly connected to the dock station 202. In one embodiment, the load cell 220 may be attached to the dock station 202 at a position that is generally beneath the auger 204. More specifically, the load cell 220 may be situated at a position generally beneath a central axis A extending through a longitudinal extent of the auger 204.

Figure 4:
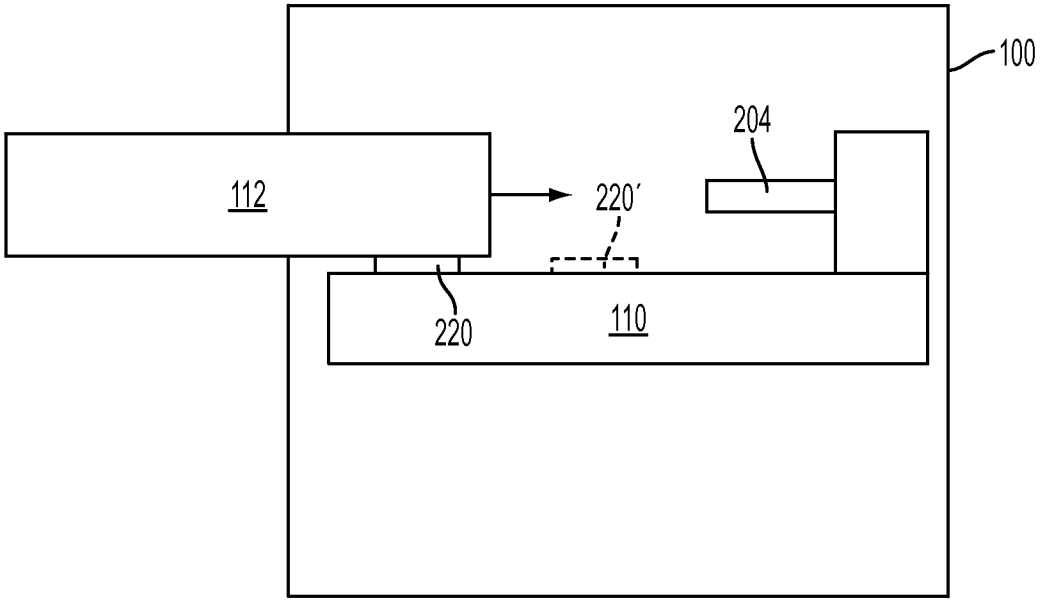
FIG. 4 is a side view of the load cell in positional relationship to a partially inserted toner cassette; and, FIG. 5 is a flow chart illustrating a system incorporating the present disclosure.

FIG. 3 illustrates the load cell 220 attached to a front oriented portion of the dock station 220. In one embodiment, the load cell 220 may be attached to the dock station 202 at a position that is in front of a terminal end 218 region of the spigot 204. In one embodiment, the load cell may be positioned anywhere along a frontal region 222 of the dock station 202 defined between the terminal end 218 of the spigot 204 and the front door panel 224 used to access to the image forming apparatus. Positioned in a frontal region 222 of the developer mechanism 110, the load cell 220 may be adapted to deflect when a weight of the toner cassette 112 falls downwardly onto it during insertion. In one embodiment, the load cell 220 may be adapted to snap the toner containing component 112 into a secure position after it is fully inserted. It is contemplated that a load cell 220 of this embodiment is situated a distance from a distal end (i.e., at support plate 212) of the auger 204. This distance is greater than a longitudinal extent of the toner containing component 112. In other words, a fully inserted toner containing component 112 may not be in deflecting contact with the load cell 212. In another embodiment (not illustrated), the load cell 220 may be positioned behind the terminal end 218 of the spigot 204. In one contemplated embodiment, the load cell 220' may be situated generally under a midpoint along a longitudinal extent of a fully inserted toner cassette 112. The alternate position for the load cell 220' is further illustrated in phantom in FIG. 4.

Because the load cell 220 is situated in proximity to the toner containing component 112, it may also include a smooth anti-friction outer coating adapted to reduce friction at contact surfaces between it and the toner containing component 112 rolling over it. Because the load cell 220 is stationary and the toner containing component 112 is rotateable, a Teflon® or similar functioning coating may be well suited.

In one embodiment, the load cell 220 may include a height that adapts it to deflect only when toner cassettes 112 meeting certain weight thresholds (e.g., heavier cassettes) are inserted into the image forming apparatus 100. The load cell 220 is adapted to detect a presence of the toner cassette 112 based upon the sensed deflection. The toner cassette 112 may deflect the load cell 220 when it is slid onto the dock station 202 to receive the spigot 204. Once the load cell 220 senses a deflected state, it may send a signal to the controller 32 of FIG. 1. In one embodiment, the load cell 220 may send a signal representative of a characteristic measurement. The characteristic measurement may be a mass (or weight) value. In one embodiment, the processor 12 (see FIG. 1) may selectively search for a mass signal representative of a full toner cassette when a deflection signal is received. In another embodiment, the processor 12 may search for a signal representative of a mass of a toner cassette 220 having any fullness level. The processor 12 may include the mass signal as a variable in a computation for determining the percentage toner volume contained in the cassette 112. For example, the toner processor may calculate a mass differential between the input toner cassette mass value and a reference value. The reference value may correspond to a mass of a full toner cassette having 100% toner volume. In another embodiment, the processor 12 is adapted to determine a toner volume (herein synonymously referred to as a "toner level" or a "toner capacity") contained in the toner cassette 112 based on the mass differential.

An alternate embodiment may include using the sensed toner cassette mass as an input variable in a Look-Up Table. A corresponding output value may indicate a percent level of toner available and/or remaining in the toner cassette. For example, a mass value sensed by the load cell system may be representative of a toner capacity level at every $10^{th}$ percentage or every $25^{th}$ percentage.

In one embodiment, the received mass signal or computed output value may be compared to at least a first threshold value. This threshold value may correspond to and/or approximate a reference mass programmed in the memory 14 of the controller 32 for a full toner cassette. In one embodiment, the threshold value may approximate a low-level toner cassette. The mass of a low toner cassette is approximately $1/10^{th}$ a mass of the full toner cassette. If the low-level threshold is not met, then the cassette may be determined as satisfying an empty condition.

The controller 32 may control an operation of the printing apparatus based on whether the mass or computed output value meets at least one threshold. The controller 32 is adapted to drive or suspend the motor 206 (see FIG. 3) of the developer station 110 (and/or the photoreceptor drum 104) to control an operation of the image forming apparatus 100 based on the toner volume. If the mass signal corresponds to a full toner cassette (i.e., it meets the first threshold value), the controller 32 is adapted to initiate a print cycle when the toner cassette 112 is fully inserted in the apparatus. If the mass signal does not correspond to a full toner cassette (i.e., it does not meet the first threshold value), it may be compared to a second threshold value. The second threshold value aims to distinguish between a partially full toner cassette, having a remainder volume of usable toner, and a low-level or empty toner cassette, which places risks to the internal stations of the apparatus. This second threshold value may be programmed as approximately $1/10^{th}$ a reference mass of a full toner cassette.

If the mass signal or computed output value meets the second threshold, the controller 32 is adapted to initiate a print cycle. The controller 32 may further energize an indication informing the user that the toner cassette 112 is partially full. This indication may include a visual indicator light or message on a display. This indicator may also include an amount or volume of toner available for rendering images on media. The indication may additionally or alternately include an audible warning. Generally, it is contemplated that the controller 32 may provide for at least one programmed allowance. Accordingly, the print cycle may be restarted for the determined, partially full toner cassettes reinserted in the image forming apparatus 100. However, in one embodiment, the controller 32 may prevent any print cycle operation when the load cell 220 is not in a deflected state. Accordingly, the low level toners are not heavy enough to partially or fully deflect the load cell 220.

If the mass signal fails to meet the predetermined second threshold value, the controller 32 may be adapted to prevent a print cycle operation. The controller 32 may indicate an error. More specifically, the controller 32 may be adapted to prohibit any override operation until a replacement cassette is inserted in the apparatus. Therefore, the processor 12 may search for the load cell 220 to return to both a non-deflected state and then a deflected state.

Figure 5:
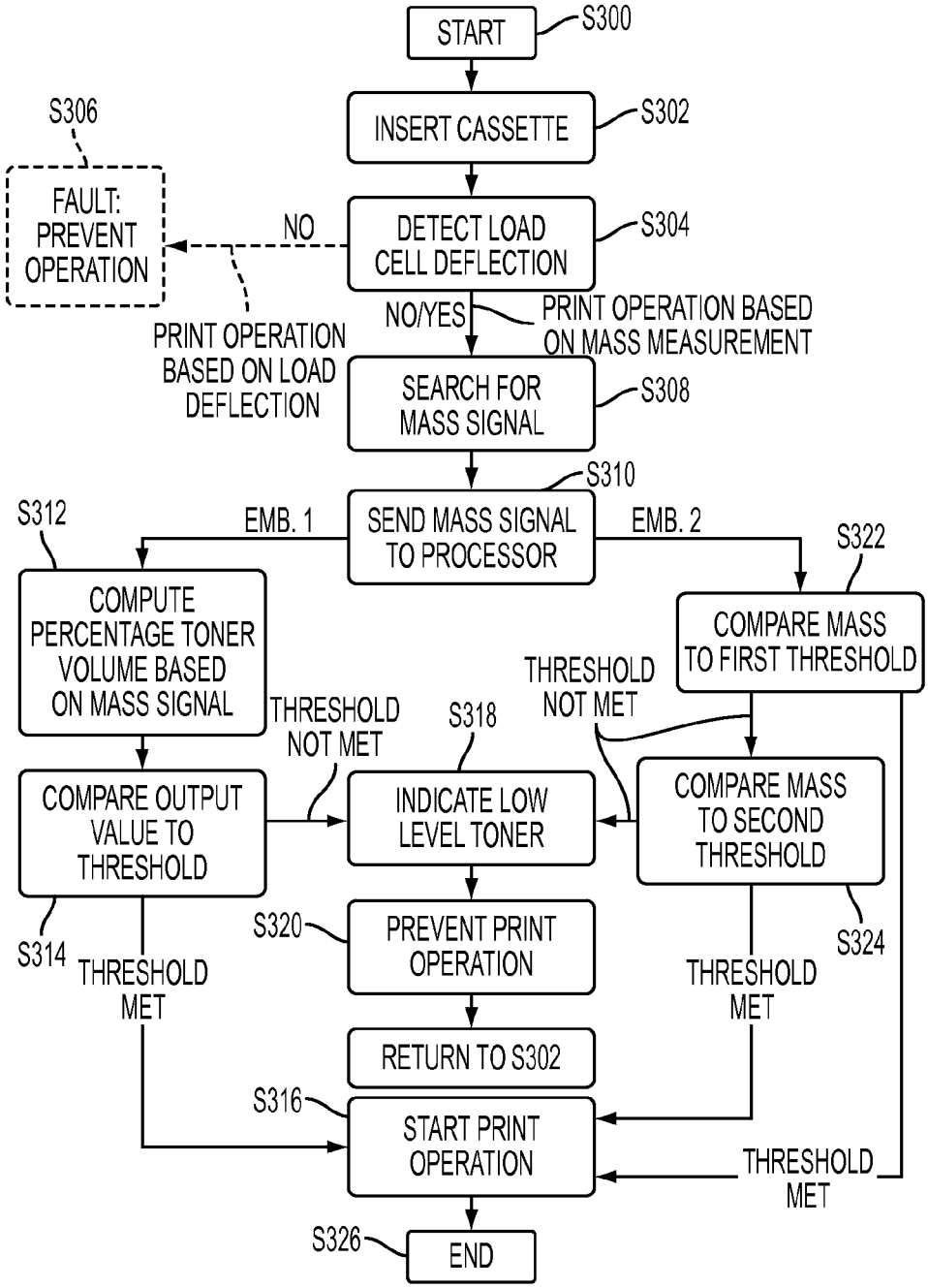

FIG. 5 illustrates a method according to the disclosure. A main memory (14 of FIG. 1) stores instructions that cause the processor 12 to perform the actions. The sequence of actions initiate at start S300. A low level toner cassette (hereinafter referred to as "old cassette") is removed from the apparatus. A toner cassette is at least partially inserted at S302. In one embodiment, the toner cassette may deflect the load cell only if it meets a predetermined fullness level (i.e., it deflects the load cell downwardly a predetermined distance). In another embodiment, a presence of any fullness level toner cassette may effect a deflection of the load cell at S304. The controller prevents a print operation at S306 when the load cell is not in a deflected state. However, a print operation may alternatively be based on a mass value measured by a deflected load cell. If the load cell is deflected, the processor searches for a signal at S308 indicating a mass of the toner cassette. The load cell sends the mass signal S310 to the processor.

In one embodiment (referred to as Emb. 1), a percentage of toner volume is calculated at S312 using the volume percentage calculation component (24 of FIG. 1). The mass value is used as an input variable. The processor may output a volume of toner contained in the toner cassette based on the mass value. This volume may be compared against a full toner volume and may be expressed as a percentage of volume remaining in the toner cassette. In another embodiment, a mass differential may be computed between the mass value and a reference full toner mass value. The difference may similarly be used to determine the volume of toner remaining in the cassette. A look-up table may be used to output the volume percentage.

In one embodiment, the output value may be compared to a threshold S314. In one example, this threshold may include a predetermined mass differential or a predetermined percentage of toner volume. If the output value meets the threshold, the controller may institute a print cycle S316. However, the controller may alternatively indicate a low-level of toner volume 5318 if the output value does not meet the threshold. The controller may prevent a print operation S320 from instituting until the load cell senses deflection caused by a replacement cassette. The process returns to S302 and repeats until the replacement cassette is determined as having a partial-full or a full level toner volume.

In another embodiment (referred to as Emb. 2), the processor may compare the received mass value to at least a first threshold at S322. This threshold value may approximate a mass corresponding to a full toner cassette. If the mass signal meets the first threshold, the print operation may be instituted at S316. If the print operation is instituted, the process ends at S322. However, if the mass signal fails to meet the first threshold, the mass value may be compared to a second threshold value at S324. In one embodiment, this second threshold value may approximate one-tenth (1/10) a mass of a full toner cassette. This second threshold value may be indicative of an empty toner cassette. Accordingly, the controller may indicate the low-level toner at S318 and prevent an operation S320 of the image forming apparatus when the second threshold is not met.

It is known that operators may attempt to obtain additional print cycles using the old cassette. One aspect of this action is that a partially full toner cassette is not prematurely discarded when there is a remaining volume of toner. These operators typically shake up the cassette and (partially or fully) reinsert it into the image forming apparatus.

In one embodiment, the controller may be programmed to recognize reinsertion of the old cassette without preventing output operations. The controller may be programmed to restart the cycle for an allowance of at least one shake-up of the toner cassette in an attempt to utilize the remaining low level of toner contained in the cassette. The controller may distinguish between the partially full old cassette and an empty cassette using the second threshold value. If the mass value meets the second threshold value, then the print operation may be reinstituted S322 by the controller.

Alternatively, in one embodiment the controller may be programmed to not accept any old toner bottles in any circumstance. In either instance, the controller may suspend any output of images until a full toner cassette replacement is sensed as being installed in the apparatus.

Although the control method is illustrated and described above in the form of a series of acts or events, it will be appreciated that the various methods or processes of the present disclosure are not limited by the illustrated ordering of such acts or events. In this regard, except as specifically provided hereinafter, some acts or events may occur in different order and/or concurrently with other acts or events apart from those illustrated and described herein in accordance with the disclosure. It is further noted that not all illustrated steps may be required to implement a process or method in accordance with the present disclosure, and one or more such acts may be combined. The illustrated methods and other methods of the disclosure may be implemented in hardware, software, or combinations thereof, in order to provide the control functionality described herein, and may be employed in any system including, but not limited to, the above illustrated system, wherein the disclosure is not limited to the specific applications and embodiments illustrated and described herein.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. An image forming apparatus adapted to distinguish a presence between a full and a non-full toner cassette, comprising:

a load cell positioned at frontal region of a dock between a spigot and a door panel in a developer station, the load cell adapted to:

sense a mass of a toner cassette at least during an insertion of the toner cassette into the image forming apparatus, deflect when the toner cassette is inserted into the image forming apparatus, and snap the toner cassette into secure placement in the image forming apparatus when the toner cassette is fully inserted; and, a processor adapted to determine a toner volume contained in the toner cassette based on a mass value received at a controller;

wherein the controller is adapted to drive or suspend a motor of the developer station to control an operation of the image forming apparatus based on the toner volume.

2. The image forming apparatus of claim 1, wherein the load cell is fixedly attached to the dock in the developer station.

3. The image forming apparatus of claim 1, wherein the load cell is situated toward a front region of the developer station.

4. The image forming apparatus of claim 1, wherein an attachment of the load cell to the developer station is removed from an interface between the toner cassette and an auger screw.

5. The image forming apparatus of claim 1, wherein the load cell includes a smooth anti-friction coating adapted to reduce friction at a contact between the load cell and the toner cassette rolling over it.

6. The image forming apparatus of claim 1, wherein the processor is adapted to determine if the mass meets a threshold.

7. The image forming apparatus of claim 6, wherein the threshold approximates a mass of a full toner cassette.

8. The image forming apparatus of claim 6, wherein the threshold approximates a mass of about $1/10^{th}$ of a full toner cassette.

9. A method for detecting a fullness level of toner cassette inserted into an image forming apparatus, the method comprising:

at least partially inserting a toner cassette into a developer station of the image forming apparatus;

deflecting when the toner cassette is inserted into the image forming apparatus, determining if a load cell positioned at a frontal region of the developer station between a spigot and a door panel is deflected by the toner cassette;

searching by a processor for a full mass representative of a full toner cassette when deflection of the load cell is determined;

sending a signal representative of a mass to a processor;

snapping the toner cassette into secure placement in the image forming apparatus when the toner cassette is fully inserted; and, controlling an operation of a print cycle based on the signal.

10. The method of claim 9, further including determining if the mass meets a threshold.

11. The method of claim 9, further including using a mass differential to detect between a full toner cassette and a less-than-full toner cassette.

12. The method of claim 11, further including comparing the mass to a reference mass equal to a full toner cassette.

13. The method of claim 12, further including comparing the mass to a reference mass that is equal to $1/10^{th}$ of a full toner cassette if the mass is not equal to or greater than a full toner cassette.

14. The method of claim 13, further including preventing a print cycle operation if the mass is less than the reference mass.

15. The method of claim 9, further including preventing a print cycle operation if the load cell is determined as not deflected.

16. The method of claim 9, further including snapping the toner cassette in place by the load cell.

17. An image forming apparatus adapted to control a print operation based on a detected toner cassette, the image forming apparatus comprising:

a developer station, including:

an auger mechanism having an auger screw rotatably positioned within a stationary spigot, the auger screw adapted to pull toner from a toner cassette, a motor adapted to rotate the auger screw, and a dock station for supporting the toner cassette; and, a load cell positioned in a front region of the dock station and removed a distance from an interface between the auger screw and the toner cassette, the load cell being adapted to detect a deflection made by the toner cassette and detect a mass of the toner cassette representative of a volume of toner contained in the toner cassette, the load cell being further adapted to deflect when the toner cassette is inserted into the image forming apparatus and snap the toner cassette into secure placement in the image forming apparatus when the toner cassette is fully inserted.

18. The image forming apparatus of claim 17, further including a processor adapted to receive a signal from the load cell representative of the mass, compare the signal to at least one reference selected from a value corresponding to a full toner cassette and an empty toner cassette, and determine if the signal meets at least one threshold.

19. The image forming apparatus of claim 18, further including a controller adapted to control an operation of the motor based on the signal meeting the threshold.

* * * * *